United States Patent [19]

Shuto et al.

[11] Patent Number: 4,626,498

[45] Date of Patent: Dec. 2, 1986

[54] COLOR REVERSAL PHOTOGRAPHIC LIGHT-SENSITIVE MATERIAL

[75] Inventors: Sadanobu Shuto; Yasuhiro Hayashi; Munehisa Fujita; Kazunori Hasebe, all of Kanagawa, Japan

[73] Assignee: Fuji Photo Film Co., Ltd., Japan

[21] Appl. No.: 612,217

[22] Filed: May 21, 1984

[30] Foreign Application Priority Data

May 20, 1983 [JP] Japan ..... 58-88939

[51] Int. Cl.[4] ..... G03C 5/50

[52] U.S. Cl. ..... 430/379; 430/523; 430/503; 430/506; 430/505; 430/567

[58] Field of Search ..... 430/379, 567, 523, 503, 430/506, 505

[56] References Cited

U.S. PATENT DOCUMENTS

| | | | |
|---|---|---|---|
| 2,996,382 | 8/1961 | Luckey et al. | 430/567 |
| 3,178,282 | 4/1965 | Luckey et al. | 430/567 |
| 3,206,313 | 9/1965 | Porter et al. | 430/567 |
| 3,317,322 | 5/1967 | Porter et al. | 430/599 |
| 3,367,778 | 2/1968 | Berriman | 430/411 |
| 3,397,987 | 8/1968 | Luckey et al. | 430/602 |
| 3,505,068 | 4/1970 | Beckett et al. | 430/567 |
| 3,647,452 | 3/1972 | Hendess et al. | 430/379 |
| 4,146,395 | 3/1979 | Bissonette | 430/379 |

*Primary Examiner*—Won H. Louie

*Attorney, Agent, or Firm*—Sughrue, Mion, Zinn, Macpeak and Seas

[57] ABSTRACT

A color reversal photographic light-sensitive material is described having at least one light-sensitive silver halide emulsion layer, wherein at least one of said emulsion layer and a layer adjacent thereto contains a silver halide emulsion of silver halide grains containing internal fog centers.

13 Claims, No Drawings

COLOR REVERSAL PHOTOGRAPHIC LIGHT-SENSITIVE MATERIAL

FIELD OF THE INVENTION

This invention relates to a color reversal photographic light-sensitive material having an improved adaptability to push processing.

BACKGROUND OF THE INVENTION

Color reversal photographic light-sensitive materials usually comprise a support having provided thereon at least two silver halide emulsion layers having a different color sensitivity (the term "color sensitivity" as used herein meaning the property of responding to one of the regions of the visible spectrum, e.g., to one of red, green and blue light).

In the field of color photographic light-sensitive materials, particularly color reversal light-sensitive materials popularly used among professional photographers, high speed color light-sensitive materials are required for photographing special scenes, such as sports scenes which require a high shutter speed, and stage scenes in which only an insufficient amount of light is generally available for exposure. However, few color photographic light-sensitive materials have a high enough speed to photograph such special scenes. Under such circumstances, the speed has been adjusted through some processing for supplementing the insufficient exposure of a color reversal film which has been taken photograph at higher speed than indicated speed of the film. This speed-adjusting processing is usually called "push processing", and, with color reversal light-sensitive materials, it is conducted by pushing first development (black-and-white development), for example, prolonging the period of first development longer than is employed in normal processing.

However, conventional color reversal light-sensitive materials do not have sufficient adaptability to the push processing, and thus exhibit the following defects:

(1) sufficient effect of increase in speed cannot be attained unless the period of first development is extremely prolonged in comparison with the normal processing;

(2) with light-sensitive materials having a structure wherein the silver halide emulsion layer having specified color sensitivity is formed as two or more separate layers of unequal speed (e.g., a higher speed layer and lower speed layer), the push processing can lead to a change in gradation between the two or more layers due to the difference therebetween in adaptability to development processing;

(3) prolongation of the period of first development for raising the degree of increase in speed can cause a serious decrease in color image density; or (4) push processing can cause deterioration of color balance due to the difference between the red-sensitive layer, green-sensitive layer and blue-sensitive layer in adaptability to development processing.

Thus, it has been desired to develop techniques which overcome the above-described defects and which enable full control of the degree of increase in speed without exerting any detrimental influence upon normal processing.

An object of the present invention is to provide the above-described techniques and color reversal photographic light-sensitive materials embodying them.

Japanese Patent Application (OPI) No. 128528/76 (corresponding to U.S. Pat. No. 4,082,553) (the term "OPI" as used herein refers to a "published unexamined Japanese patent application") describes a color reversal light-sensitive material with an improved interimage effect which has a silver halide emulsion layer interspersed with surface-fogged silver halide grains that are distinctive from silver halide grains containing internal fog centers. However, addition of the surface-fogged silver halide grains adversely effects photographic properties in normal processing and seriously decreases color image density in push processing.

U.S. Pat. Nos. 2,996,382, 3,178,282 and 3,397,987 describe a negative image-forming photographic element of enhanced speed and contrast prepared by incorporating a combination of unfogged surface latent image silver halide grains and fogged internal latent image silver halide grains in an emulsion layer. However, these patents do not refer to push processing nor color reversal light-sensitive materials. Further, the element is designed so that, upon development after exposure, the unfogged surface latent image silver halide grains develop to liberate reaction products in proportion to an exposure amount, and then the reaction products crack the fogged internal latent image silver halide grains to render the grains developable. This element undergoes an increase in speed and contrast even upon normal processing, thus being unable to permit control of increase in speed by push processing.

Further, Japanese Patent Publication No. 19024/71 (corresponding to U.S. Pat. No. 3,505,068) describes a technique with respect to color reversal light-sensitive materials in which one or more emulsion layers of the same color sensitivity are formed as a combination of a higher speed layer and a lower speed layer, which technique comprises effectively decreasing contrast by using silver iodide in the higher speed layer and using grains of silver haloiodide core covered with completely silver iodide-free silver halide shell in the lower speed layer. However, the core-shell type silver halide grains used therein have no internal fog centers, and hence, they do not show any special action with respect to push processing.

SUMMARY OF THE INVENTION

The objects of the present invention involve overcoming the problems existing in the art as described above, and can be attained by a color reversal photographic light-sensitive material having at least one light-sensitive silver halide emulsion layer, wherein at least one of said emulsion layer and a layer adjacent thereto contains a silver halide emulsion of silver halide grains containing internal fog centers therein.

DETAILED DESCRIPTION OF THE INVENTION

Silver halide emulsions of silver halide grains containing internal fog centers therein are not developable at all by normal processing, and become uniformly developable in both unexposed portions and exposed portions only when subjected to push processing. It can be determined according to the following test whether a particular emulsion can be used as the silver halide emulsion according to the present invention. That is, an emulsion to be tested is coated on a film support in a coated silver amount of 0.5 g/m$^2$, and the resulting sample is processed (without exposure) at 38° C. for 2 minutes (normal processing) and at 38° C. for 10 minutes (push processing) using a developer of the following formulation.

| Formulation of Developer: | |
|---|---|
| Water | 700 ml |
| Sodium Tetrapolyphosphate | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% aq. soln.) | 2 ml |
| Water to make | 1 liter |

Emulsions used for samples which are found, as a result of the test, to show almost no increase in density in the 2-minute processing but show, when subjected to the 10-minute processing, an increase in density as high as at least five times that obtained by the 2-minute processing are suited to be used as the silver halide emulsion of the present invention containing internal fog centers.

The silver halide emulsion of silver halide grains containing internal fog centers selected through the above test, when the emulsion is used in a pertinent amount, does not affect development of light-sensitive silver halide emulsion adjacent thereto in normal processing, and accelerates development of the light-sensitive silver halide in both unexposed area and exposed area in push processing.

Preferable examples of the above-described silver halide emulsions of silver halide grains containing internal fog centers are those emulsions which contain core-shell type silver halide grains each comprising a surface-fogged silver halide internal core and a silver halide outer shell covering the core.

Such core-shell type silver halide grains containing internal fog centers are generally prepared by forming silver halide grains which are to be used for forming internal core, chemically or optically fogging the surfaces of the silver halide grains, and then depositing silver halide on the internal core-forming silver halide grains to form an outer shell thereon.

The aforesaid fogging step can be effected by adding a reducing agent or a gold salt under properly controlled pH and pAg conditions, by heating at low pAg, or by uniform overall exposure. As the reducing agents, stannous chloride, hydrazine compounds, ethanolamine, thiourea dioxide, etc., can be used.

The use of the above-described core-shell type silver halide grains is advantageous because emergence of the effect of push processing can be timed by properly selecting the thickness of the outer shell. Accordingly, the thickness of outer shell is to be determined according to how long the first development is prolonged for obtaining the effect of increase in speed. Within the range of prolonged time employed in ordinary push processing, the thickness of outer shell is preferably selected between 50 and 1,000 Å. A thickness of 100 to 500 Å can provide particularly good results.

The silver halide forming the internal core of the core-shell type silver halide grains may have the same silver halide composition as, or different composition from, that forming the outer shell.

As the silver halide of silver halide grains containing internal fog centers, any of silver chloride, silver bromide, silver chlorobromide, silver bromoiodide, silver chlorobromoiodide, etc., may be used.

Grain sizes of the silver halide grains containing internal fog centers are not particularly limited, but fine grains are preferable. Particularly preferable mean grain sizes range from 0.01 to 0.75$\mu$, and more preferably from 0.01 to 0.5$\mu$.

The silver halide grains containing internal fog centers are not particularly limited as to the grain form, and may be in a regular grain form or in an irregular grain form.

The silver halide emulsion of silver halide grains containing internal fog centers may be a polydisperse system, but monodisperse emulsions (having a coefficient of variation, CV, of 20% or less) are preferable.

It is possible to control the timing of emergence of the effect of push processing by using, apart from or together with the above-described means for changing the thickness of outer shell, the silver halide grains containing internal fog centers and a certain kind of organic compound in combination. The compound used for such a means is that which show high adsorption on silver halide grains. Namely, since the compound is adsorbed on the surface of silver halide grains containing internal fog centers to delay the timing of exposing the fog centers, it is possible to control the timing of emergence of the effect of push processing by controlling the amount of adsorption (that is, by changing the ratio of the silver halide containing internal fog centers to the organic compound).

As the organic compounds capable of suitably using for the above-described means, there are cyanine dyes, merocyanine dyes, nitrogen-containing heterocyclic mercapto compounds, onium salts and the like. Preferably, there are compounds represented by the following general formulae (I) to (IV). Further, all of the compounds represented by the general formulae (I) to (IV) are known compounds and they are easily available or can be easily synthesized.

General Formula (I) (cyanine dye):

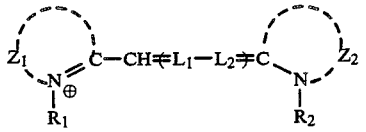

In the formula (I), $Z_1$ and $Z_2$ each represents an atomic group necessary to form a thiazole nucleus, a thiazoline nucleus, a benzothiazole nucleus, a naphthothiazole nucleus, an oxazole nucleus, a benzoxazole nucleus, an oxazoline nucleus, a naphthoxazole nucleus, an imidazole nucleus, a benzimidazole nucleus, an imidazoline nucleus, a selenazole nucleus, a selenazoline nucleus, a benzoselenazole nucleus or a naphthoselenazole nucleus.

$R_1$ and $R_2$ each represents an alkyl group or a substituted alkyl group, but at least one of $R_1$ and $R_2$ has a sulfo group or a carboxyl group.

$L_1$ and $L_2$ each represents a substituted or unsubstituted methine group.

n represents 0 or an integer of 1 or 2.

Substituents may be introduced into the nuclei formed by $Z_1$ and $Z_2$ as known in the field of cyanine dyes. Examples of the substituents include alkyl groups, alkoxy groups, alkoxycarbonyl groups, aryl groups, aralkyl groups and halogen atoms, etc.

$R_1$ and $R_2$ may be identical or different each other. Preferred alkyl groups of $R_1$ and $R_2$ are those having 1 to 8 carbon atoms, for example, a methyl group, an ethyl group, a propyl group, a butyl group, a pentyl group and a heptyl group, etc. As substituents in the substituted alkyl groups, there are, for example, a carboxyl group, a sulfo group, a cyano group, a halogen atom (for example, a fluorine atom, a chlorine atom and a bromine atom, etc.), a hydroxyl group, an alkoxycarbonyl group (those having 8 or less carbon atoms, for example, a methoxycarbonyl group, an ethoxycarbonyl group and a benzyloxycarbonyl group, etc.), an alkoxy group (those having 7 or less carbon atoms, for example, a methoxy group, an ethoxy group, a propoxy group, a butoxy group and a benzyloxy group, etc.), an aryloxy group (for example, a phenoxy group and a p-tolyloxy group, etc.), an acyloxy group (those having 3 or less carbon atoms, for example, an acetyloxy group and a propionyloxy group, etc.), an acyl group (those having 8 or less carbon atoms, for example, an acetyl group, a propionyl group, a benzoyl group and a mesyl group, etc.), a carbamoyl group (for example, a carbamoyl group, an N,N-dimethylcarbamoyl group, a morpholinocarbamoyl group and a piperidinocarbamoyl group, etc.), a sulfamoyl group (for example, a sulfamoyl group, an N,N-dimethylsulfamoyl group and a morpholinosulfamoyl group, etc.) and an aryl group (for example, a phenyl group, a p-hydroxyphenyl group, a p-carboxyphenyl group, a p-sulfophenyl group and an α-naphthyl group, etc.). The preferred number of carbon atoms in the substituted alkyl groups is 6 or less.

As substituents in the substituted methine groups in $L_1$ and $L_2$, there are a lower alkyl group (for example, a methyl group, an ethyl group and a propyl group, etc.), a phenyl group and a benzyl group, etc.

General Formula (II) (merocyanine dye):

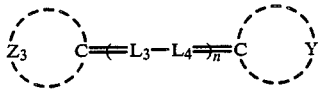

In the formula (II), $Z_3$ represents an atomic group of forming a basic carbocycle or an atomic group of forming a basic heterocycle, Y represents an atomic group of forming an acidic carbocycle or an atomic group of forming an acidic heterocycle, $L_3$ and $L_4$ each represents a substituted or unsubstituted methine group, and n represents 0, 1, 2 or 3.

Examples of the basic carbocycle or the basic heterocycle represented by $Z_3$ include an oxazole ring, a benzoxazole ring, an oxazoline ring, a naphthoxazole ring, a thiazole ring, a benzothiazole ring, a thiazoline ring, a naphthothiazole ring, a selenazole ring, a benzoselenazole ring, a selenazoline ring, a naphthoselenazole ring, a pyridine ring, a quinoline ring, an imidazole ring, a benzimidazole ring, a naphthoimidazole ring, an indolenine ring and an indole ring, etc.

Of these rings, a benzoxazole ring, an oxazoline ring, a naphthoxazole ring, a thiazole ring, a benzothiazole ring, a thiazoline ring, a naphthothiazole ring, a selenazole ring, a benzoselenazole ring, a pyridine ring, a quinoline ring, a benzimidazole ring and an indolenine ring are preferred.

Examples of the acidic carbocycle or the acidic heterocycle represented by Y include a thiohydantoin ring, a rhodanine ring, an oxazolin-4-one-2-thione ring, a pyrazolone ring, a barbituric acid ring, a thiobarbituric acid ring, a dimedone ring, an indane-1,3-dione ring and a 2-thioselenazoline-2,4-dione ring, etc.

Of these rings, a thiohydantoin ring, a rhodanine ring and an oxazolin-4-one-2-thione ring are preferred.

Various substituents known in the field of merocyanine dyes may be present in the rings formed by $Z_3$ and Y.

Examples of substituents in the substituted methine groups represented by $L_3$ and $L_4$ include lower alkyl group, etc.

General Formula (III) (nitrogen-containing heterocyclic mercapto compound):

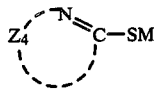

In the formula (III), M represents a hydrogen atom, a cation (for example, a sodium ion, a potassium ion or an ammonium ion, etc.) or a protective group of the mercapto group which cleaves with alkali (for example, —COR′, —COOR′ or —$CH_2CH_2$COR′, etc., wherein R′ represents a hydrogen atom, an alkyl group, an aralkyl group or an aryl group, etc.).

$Z_4$ represents an atomic group necessary to form a 5-member or 6-member hetero ring. This hetero ring contains hetero atoms such as a sulfur atom, a selenium atom, a nitrogen atom or an oxygen atom, etc., which may be fused. Further, the hetero ring or the fused ring may have substituents.

Examples of $Z_4$ include tetrazole, triazole, imidazole, oxazole, thiadiazole, pyridine, pyrimidine, triazine, azabenzimidazole, purine, tetraazaindene, triazaindene, pentaazaindene, benzotriazole, benzimidazole, benzoxazole, benzothiazole, benzoselenazole and naphthimidazole, etc. These rings may be substituted by substituents such as an alkyl group (for example, a methyl group, an ethyl group, an n-hexyl group, a hydroxyethyl group and a carboxyethyl group, etc.), an alkenyl group (for example, an allyl group, etc.), an aralkyl group (for example, a benzyl group and a phenethyl group, etc.), an aryl group (for example, a phenyl group, a naphthyl group, a p-acetamidophenyl group, a p-carboxyphenyl group, an m-hydroxyphenyl group, a p-sulfamoylphenyl group, a p-acetylphenyl group, an o-methoxyphenyl group, a 2,4-diethylaminophenyl group and a 2,4-dichlorophenyl group, etc.), an alkylthio group (for example, a methylthio group, an ethylthio group and an n-butylthio group, etc.), an arylthio group (for example, a phenylthio group and a naphthylthio group, etc.), an aralkylthio group (for example, a benzylthio group, etc.) and a mercapto group, etc. Further, the fused rings may be substituted by a nitro group, an amino group, a halogen atom, a carboxyl group or a sulfo group, etc., in addition to the above-described substituents.

General Formula (IV) and Dimer Thereof (onium salt):

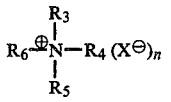

In the formula (IV), $R_3$ to $R_6$ each represents an alkyl group, which is preferred to have 30 or less carbon atoms (for example, a methyl group, an ethyl group, an n-butyl group, an n-hexyl group or an n-dodecyl group, etc.), an aryl group, which is preferred to have 30 or less carbon atoms (for example, a phenyl group, a naphthyl group, a tolyl group or a p-ethylphenyl group, etc.) or an aralkyl group, which is preferred to have 30 or less carbon atoms (for example, a benzyl group or a phenethyl group, etc.). $R_3$ to $R_6$ are selected so as to have a total number of carbon atoms of 6 or more. Further, $R_3$, $R_4$ and $R_5$ may form a quaternary nitrogen-containing hetero ring. X represents an anion. n represents 0 in case that the compound forms an inner salt, or 1 in the other case.

Of the general formula (IV), the case in which $R_3$, $R_4$ and $R_5$ form a quaternary nitrogen-containing hetero ring is most preferred. Namely, compounds represented by the following general formula (IVa) and dimers thereof are preferred.

General Formula (IVa):

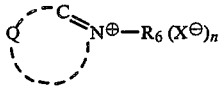

Q is a quaternary nitrogen-containing hetero ring, for example, a pyridium ring, a thiazolium ring, a benzothiazolium ring or a benzimidazolium ring, etc. The ring may be substituted by an alkyl group (for example, a methyl group, an ethyl group, an n-hexyl group, a hydroxyethyl group and a carboxyethyl group, etc.), an alkenyl group (for example, an allyl group, etc.), an aralkyl group (for example, a benzyl group and a phenethyl group, etc.), an aryl group (for example, a phenyl group, a naphthyl group, a p-acetamidophenyl group, a p-carboxyphenyl group, an m-hydroxyphenyl group, a p-sulfamoylphenyl group, a p-acetylphenyl group, an o-methoxyphenyl group, a 2,4-diethylaminophenyl group and a 2,4-dichlorophenyl group, etc.), an alkylthio group (for example, a methylthio group, an ethylthio group and an n-butylthio group, etc.), an arylthio group (for example, a phenylthio group and a naphthylthio group, etc.) and an aralkylthio group (for example, a benzylthio group, etc.), etc. Further, the fused ring may be substituted by a nitro group, an amino group, a halogen atom, a carboxyl group or a sulfo group in addition to the above-described substituents.

$R_6$, $X^{\ominus}$ and n each represents the same meaning as defined above.

The dimer of the compound represented by the general formula (IV) (including the general formula (IVa)) is that in which the compounds represented by the general formula (IV) are combined with a divalent group such as an alkylene group or an arylene group.

In the following, examples of the compounds represented by the general formulae (I) to (IV) are described. However, the present invention is not limited to them.

(I-1)

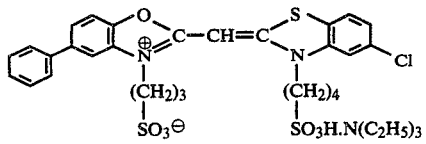

(I-2)

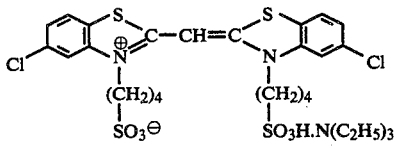

(I-3)

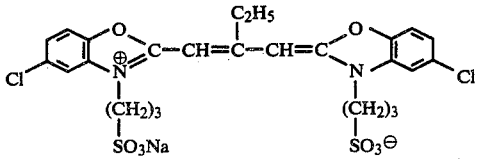

(I-4)

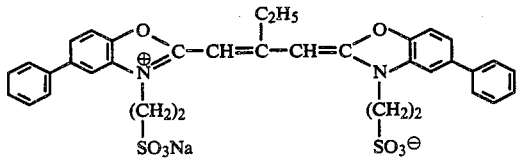

(I-5)

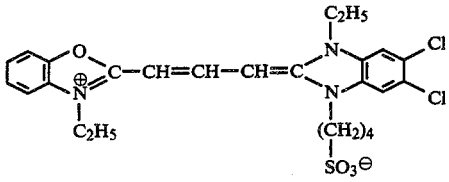

(I-6)

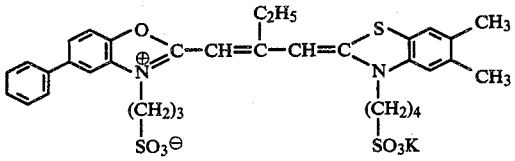

(I-7)

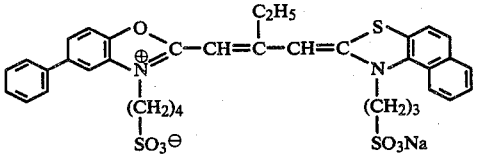

(I-8)

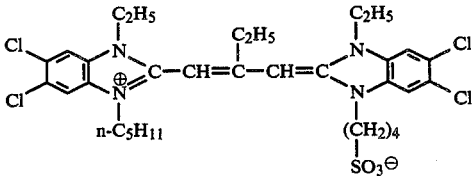

-continued
(I-9)
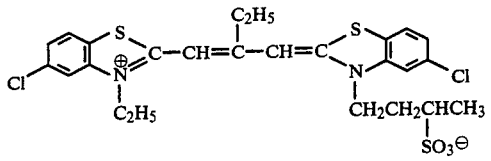
(I-10)
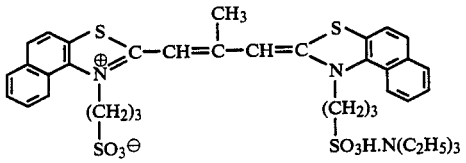
(I-11)
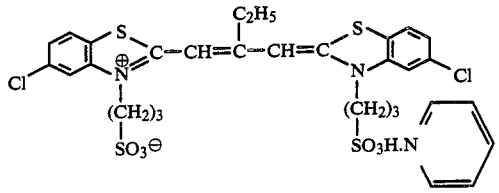
(II-1)
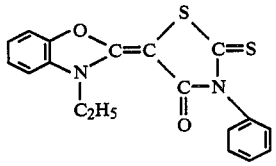
(II-2)
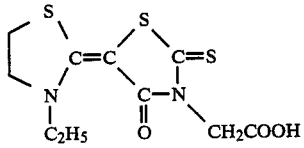
(II-3)
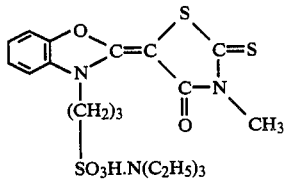
(II-4)
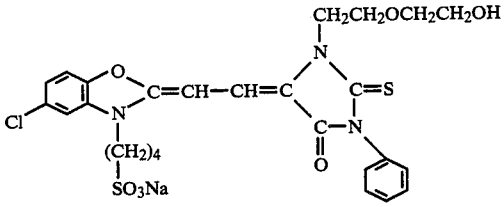
(II-5)
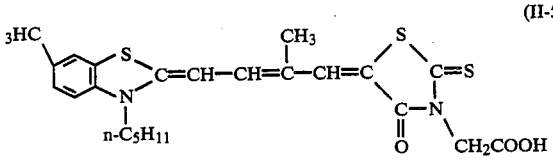
-continued
(III-1)
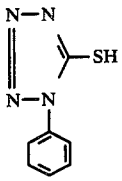
(III-2)
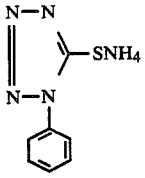
(III-3)
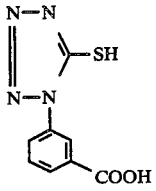
(III-4)
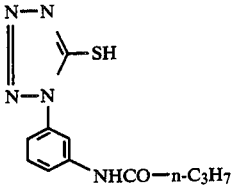
(III-5)
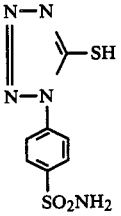
(III-6)
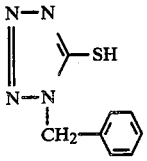
(III-7)
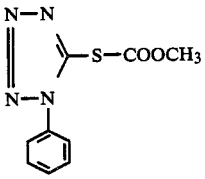
(III-8)
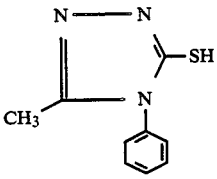

-continued
(III-9)
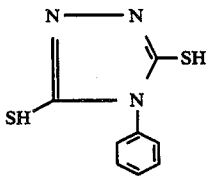
(III-10)
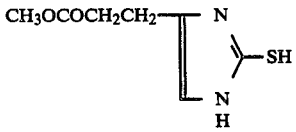
(III-11)
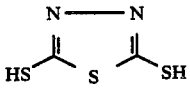
(III-12)
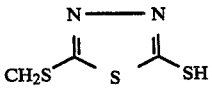
(III-13)
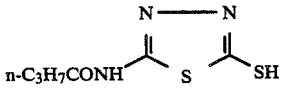
(III-14)
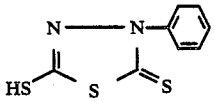
(III-15)
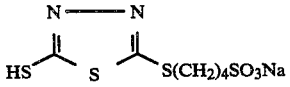
(III-16)
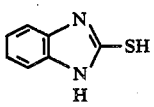
(III-17)
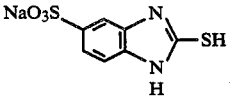
(III-18)
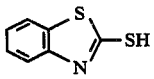
(III-19)
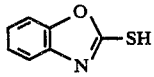
(III-20)
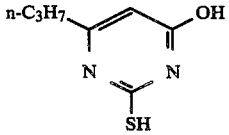
(III-21)
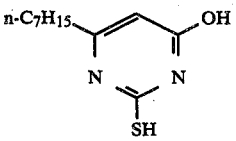
-continued
(III-22)
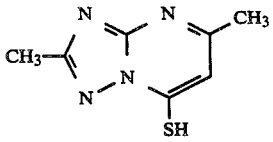
(III-23)
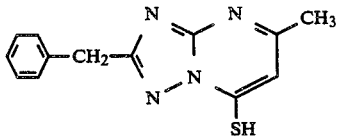
(III-24)
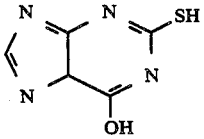
(IV-1)
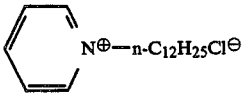
(IV-2)
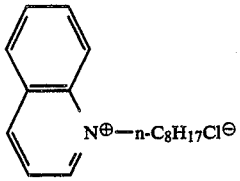
(IV-3)
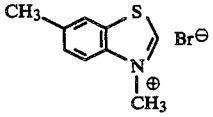
(IV-4)
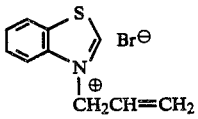
(IV-5)
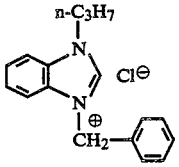
(IV-6)
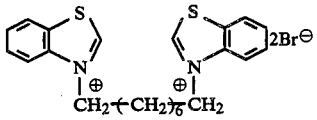
(IV-7)
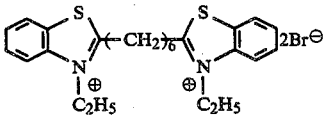
(IV-8)
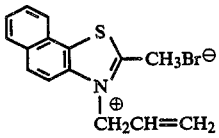

-continued

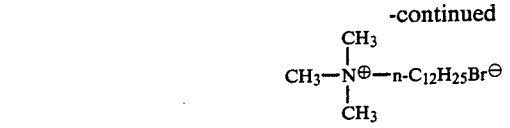

(IV-9)

In the present invention, the above-described organic compound and the silver halide emulsion of silver halide grains containing internal fog centers are used in the same layer. In case of blending both of them, it is preferred that the above-described organic compound is chiefly adsorbed on the surface of the above-described silver halide emulsion grains containing internal fog centers. Accordingly, in case of incorporating the silver halide emulsion of silver halide grains containing internal fog centers in the red-sensitive, green-sensitive or blue-sensitive silver halide emulsion layer, it is preferred that the above-described organic compound is previously added to the silver halide emulsion of silver halide grains containing internal fog centers before blending both emulsions. Particularly, in case of using cyanine or merocyanine dyes, it is useful to adopt a means of adding the dyes prior to conclusion of physical ripening of the silver halide emulsion of silver halide grains containing internal fog centers by applying a process which comprises adding dyes in a step prior to conclusion of physical ripening of silver halide emulsions as described in U.S. Pat. Nos. 2,735,766 and 3,628,960 and Japanese Patent Application (OPI) No. 26589/80.

The ratio of the above-described organic compound to the silver halide emulsion of silver halide grains containing internal fog centers is suitably varied in accordance with the thickness of outer shell of the above-described emulsion grains, as is obvious from the above descriptions, and the organic compound is generally used in a range from $10^{-5}$ to $10^{-1}$ mol, particularly from $10^{-4}$ to $10^{-2}$ mol, per mol of the silver halide containing internal fog centers.

Further, even when the above-described organic compound represented by the general formula (III) or (IV) is adsorbed on the surface of grains of light-sensitive silver halide emulsion (other than the silver halide grains containing internal fog centers), the similar effect as above can also be obtained. In this case, the organic compound represented by the general formula (III) or (IV) is generally used in a range from $10^{-5}$ to $10^{-1}$ mol, preferably from $10^{-4}$ to $10^{-2}$ mol, per mol of the light-sensitive silver halide being used together with the silver halide containing internal fog centers.

In the present invention, the silver halide emulsion of silver halide grains containing internal fog centers is incorporated in an ordinary light-sensitive silver halide emulsion layer and/or in a layer adjacent thereto. The layer or layers in which the silver halide emulsion of silver halide grains containing internal fog centers is to be incorporated are one, two or more of a red-sensitive emulsion layer and/or a layer adjacent thereto, a green-sensitive emulsion layer and/or a layer adjacent thereto, and a blue-sensitive emulsion layer and/or a layer adjacent thereto. Where one or more of the red-, green- and blue-sensitive silver halide emulsion layers are formed as two or more separed layers having the same color sensitivity and unequal speed (e.g., a higher speed layer and a lower speed layer), although the technique of the present invention can be applied to each layers of unequal speed, it is preferred that the silver halide emulsion of silver halide grains containing internal fog centers are added to the lower speed layer.

In the present invention, the silver halide emulsion of silver halide grains containing internal fog centers accelerates development of light-sensitive silver halide adjacent thereto in push processing, and, hence, where the higher speed layer and the lower speed layer are different from each other in push processing properties, deterioration of gradation for normal processing can be prevented by adding the silver halide emulsion to one of the layers that undergoes less development acceleration in the push processing. Also, deterioration of color balance upon push processing due to the difference in developability between light-sensitive layers with different color sensitivity can be similarly prevented.

Each color sensitive layer of the typical color reversal photographic material is consisting of two separate layers, i.e., a higher speed layer and a lower speed layer. In a preferred embodiment of the present invention, the silver halide emulsion of silver halide grains containing internal fog centers is added to at least one of the lower speed red-sensitive layer, lower speed green-sensitive layer and lower speed blue-sensitive layer.

In the present invention, the degree of increase in speed obtained by push processing can be varied by changing the ratio of the silver halide emulsion of silver halide grains containing internal fog centers to light-sensitive silver halide emulsion, as described below. Therefore, this ratio is to be decided depending upon desired sensitization degree. Usually, preferable effect can be obtained by using from 0.0005 to 0.5 mol, preferably from 0.001 to 0.25 mol, and more preferably 0.005 to 0.1 mol, of the silver halide emulsion of silver halide grains containing internal fog centers, per mol of light-sensitive silver halide emulsion used in combination therewith.

The "light-sensitive silver halide emulsion" is an emulsion of silver halide grains not containing internal fog centers, and the silver halide may be any of silver bromide, silver bromoiodide, silver iodide, silver chlorobromide, silver chlorobromoiodide, and silver chloride which are capable of forming latent image upon imagewise exposure. Silver halide grains in the emulsion are not particularly limited as to mean particle size (particle diameter with respect to spherical or approximately spherical particles, and edge length in the case of cubic particles; presented in terms of an average based on projected area), with particle size of $3\mu$ or less being preferable. Particle size distribution can be either narrow or broad.

The silver halide particles may be in a regular crystal form such as a cubic or octahedral form, in an irregular crystal form such as spherical or tabular form, or in a mixed form thereof, or may comprise a mixture of particles in different forms.

These photographic emulsions can be prepared by processes as described in P. Glafkides, *Chimie et Physique Photographique* (Paul Montel, 1967); G. F. Duffin, *Photographic Emulsion Chemistry* (The Focal Press, 1966); V. L. Zelikman et al., *Making and Coating Photographic Emulsion* (The Focal Press, 1964); etc. That is, any of an acidic process, a neutral process, and an ammoniacal process can be used. As a manner of reacting a soluble silver salt with a soluble halide salt, any of one side-mixing, simultaneous mixing and their combination may be employed.

A process of forming grains in the presence of excess silver ion (called reverse mixing process) can be employed as well. As one type of the simultaneous mixing, a process called controlled double jet process wherein pAg in a liquid phase in which silver halide is formed is kept constant can be employed. This process provides a silver halide emulsion containing silver halide grains of an approximately uniform particle size.

Two or more light-sensitive silver halide emulsions that have been separately prepared may be mixed for use.

During formation or physical ripening of silver halide grains, cadmium salts, zinc salts, lead salts, thallium salts, iridium salts or complex salts thereof, rhodium salts or complex salts thereof, iron salts or complex salts thereof, etc., may be allowed to coexist with the silver halide grains.

The light-sensitive silver halide emulsions may be used as so-called primitive emulsions without chemical sensitization, but are usually chemically sensitized. Chemical sensitization can be conducted according to processes as described in the aforesaid Glafkides or Zelikman et al. texts, or in H. Frieser, *Die Grundlagen der Photographischen Prozesse mit Silberhalogeniden* (Akademische Verlagsgesellschaft, 1968).

More particularly, sulfur sensitization using sulfur-containing compounds or active gelatin capable of reacting with silver ion, reduction sensitization using a reductive substance, and noble metal sensitization using compounds of noble metals such as gold can be employed, alone or in combination. As sulfur sensitizers, thiosulfates, thioureas, thiazoles, rhodanines, and other compounds can be used. Specific examples thereof are described in U.S. Pat. Nos. 1,574,944, 2,410,689, 2,278,947, 2,728,668, 3,656,955, etc. As reduction sensitizers, stannous salts, amines, hydrazine derivatives, formamidine-sulfinic acids, silane compounds, etc., can be used. Specific examples thereof are described in U.S. Pat. Nos. 2,487,850, 2,419,974, 2,518,698, 2,983,609, 2,983,610, 2,694,637, etc. For noble metal sensitization, complexes of metals of the Group VIII in the Periodic Table metals such as platinum, iridium, palladium, etc., can be used as well as gold complexes. Specific examples thereof are described in U.S. Pat. Nos. 2,399,083, 2,448,060, British Pat. No. 618,061, etc.

Each of the light-sensitive photographic emulsion layers of the light-sensitive material in accordance with the present invention may contain a color forming coupler or couplers capable of forming color by oxidative coupling with an aromatic primary amine developing agent (for example, a phenylenediamine derivative or an aminophenol derivative) in color development processing. For example, magenta couplers to be used in green-sensitive emulsion layer include 5-pyrazolone couplers, pyrazolobenzimidazole couplers, cyanoacetylcoumarone couplers, open-chain acylacetonitrile couplers, etc.; yellow couplers to be used in blue-sensitive emulsion layer include acylacetamide couplers (for example, benzoylacetanilides and pivaloylacetanilides), etc.; and cyan couplers to be used in red-sensitive emulsion layer include naphthol couplers, phenol couplers, etc. Of these couplers, nondiffusible couplers having a hydrophobic group which is a ballast group are desirable. The couplers may be of either the 4-equivalent type or the 2-equivalent type.

Specific examples of magenta color-forming couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 13041/75, 58922/77, 129538/74, 74027/74, 159336/75, 42121/77, 74028/74, 60233/75, 26541/76, 55122/78, etc.

Specific examples of yellow color-forming couplers are described in U.S. Pat. Nos. 2,875,057, 3,265,506, 3,408,194, 3,551,155, 3,582,322, 3,725,072, 3,891,445, West German Pat. No. 1,547,868, West German patent application (OLS) Nos. 2,219,917, 2,261,361, 2,414,006, British Pat. No. 1,425,020, Japanese patent Publication No. 10783/76, Japanese Patent Application (OPI) Nos. 26133/72, 73147/73, 102636/76, 6341/75, 123342/75, 130442/75, 21827/76, 87650/77, 82424/77, 115219/77, etc.

Specific examples of cyan couplers are those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77 and 90932/77.

The photographic emulsion of the present invention may be spectrally sensitized with methine dyes or the like. Dyes that can be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to cyanine dyes, merocyanine dyes, and complex merocyanine dyes. In these dyes, any of nuclei ordinarily used as basic hetero ring nuclei in cyanine dyes can be used. Examples include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; and those in which the above nuclei are fused with an alicyclic hydrocarbon ring and those in which the above nuclei are fused with an aromatic ring, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., can be used. These nuclei may be substituted in the nuclei carbon atom.

In the merocyanine dyes or complex merocyanine dyes, 5- or 6-membered hetero ring nuclei such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc., may be used as ketomethylene structure-containing nuclei.

Of these, a methine dye having nucleus which does not have a carboxyl group or a sulfo group as a substituent at a carbon atom of the nucleus is useful, since said dye can prevent reduction of maximum color density of a light-sensitive silver halide emulsion layer used in combination with a silver halide emulsion of silver halide grains containing internal fog centers.

Suitable dyes for spectral sensitization of a light-sensitive silver halide emulsion layer are represented by the following formula (A) or (B).

(A)

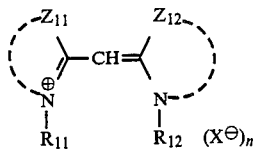

Wherein $Z_{11}$ and $Z_{12}$ each represents non-metallic atoms necessary for completing an oxazole nucleus, a benzoxazole nucleus, a naphthoxazole nucleus, a thiazole nucleus, a benzothiazole nucleus, a naphthothiazole nucleus, a benzoselenazole nucleus, a naphthoselenazole nucleus, a pyridine nucleus or a quinoline nucleus, in proviso that carbon atoms of these nuclei are not substituted by a carboxyl group or a sulfo group.

$R_{11}$ and $R_{12}$ each represents an alkyl group or a substituted alkyl group.

n represents 0 or 1.

X represents an anion.

(B)

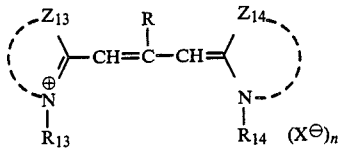

Wherein $Z_{13}$ and $Z_{14}$ each represents non-metallic atoms necessary for completing a benzoxazole nucleus, a naphthoxazole nucleus, a benzothiazole nucleus, a naphthothiazole nucleus, a benzoselenazole nucleus, a naphthoselenazole nucleus, a benzimidazole nucleus, a naphthoimidazole nucleus, a pyridine nucleus or a quinoline nucleus, in proviso that carbon atoms of these nuclei are not substituted by a carboxyl group or a sulfo group.

R represents a hydrogen atom, a lower alkyl group or an aralkyl group.

$R_{13}$ and $R_{14}$ each represents an alkyl group or a substituted alkyl group.

n represents 0 or 1.

X represents an anion.

Carbon atoms of the nucleus represented by $Z_{11}$, $Z_{12}$, $Z_{13}$ or $Z_{14}$ may be substituted by one or more substituents other than a carboxyl group and a sulfo group. For example, an alkyl group having up to 6 carbon atoms, an alkoxy group having up to 8 carbon atoms, an aryl group having up to 8 carbon atoms, an aryloxy group having up to 8 carbon atoms, an acyl group having up to 8 carbon atoms, an alkoxycarbonyl group having up to 8 carbon atoms, an acyloxy group having up to 8 carbon atoms, a cyano group, a trifluoro group, a halogen atom, etc.

$R_{11}$, $R_{12}$, $R_{13}$, $R_{14}$ each represents an alkyl group (preferably containing 1 to 8 carbon atoms, such as a methyl group, an ethyl group, an n-propyl group, an n-butyl group, etc.) or a substituted alkyl group (preferably containing 1 to 10 carbon atoms, such as a hydroxyalkyl group, an alkoxyalkyl group, an acetoxyalkyl group, an alkoxycarbonylalkyl group, a carboxyalkyl group, a sulfoalkyl group, a sulfoalkoxyalkyl group, an allyl group, a cyanoalkyl group, a carbamoylalkyl group, an aralkyl group).

R represents a hydrogen atom, an alkyl group (preferably containing 1 to 4 carbon atoms, such as a methyl group) or an aralkyl group (preferably containing up to 10 carbon atoms, such as a benzyl group).

X represents an anion such as a halide ion, a perchlorate ion, a thiocyanate ion, a methylsulfate ion, an ethylsulfate ion, a benzenesulfonate ion, a toluene-sulfonate ion, etc.

n represents 0 or 1, where dye represents a betaine compound, n is 0.

Sensitizing dyes represented by the general formula (A) or (B) are well known compounds. These sensitizing dyes are advantageously used in amounts of about $10^{-5}$ mol to $10^{-1}$ mol, especially $10^{-4}$ mol to $10^{-2}$ mol, per mol of light-sensitive silver halide in an emulsion.

Some suitable examples of the sensitizing dyes represented by the general formula (A) or (B) are illustrated below which, however, do not limit the sensitizing dyes to be used in the present invention in any way.

A-1

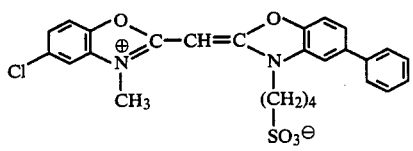

A-2

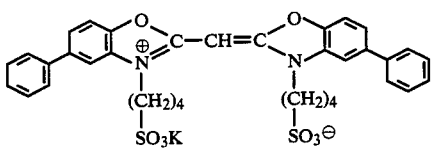

A-3

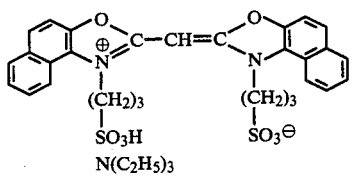

A-4

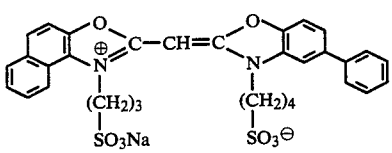

A-5

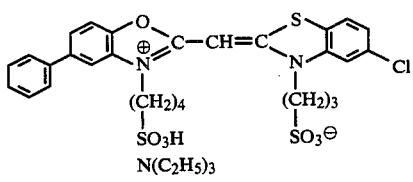

A-6

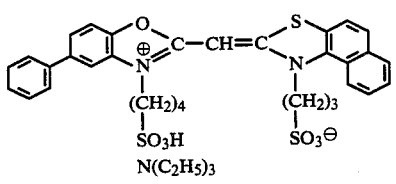

A-7

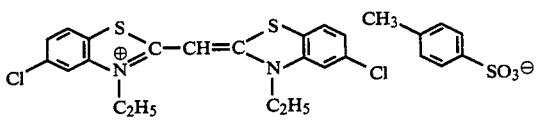

-continued
A-8
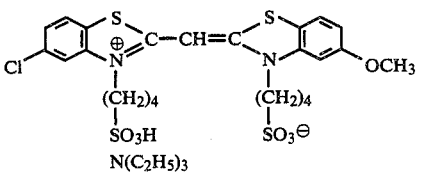
A-9
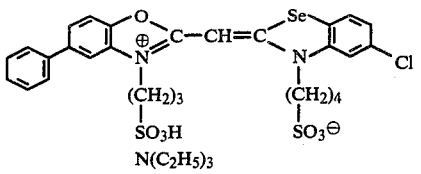
A-10
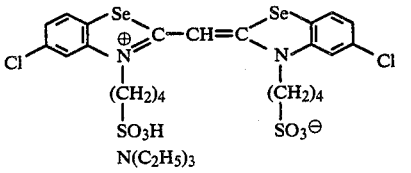
B-1
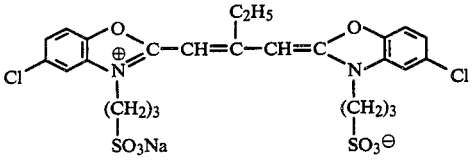
B-2
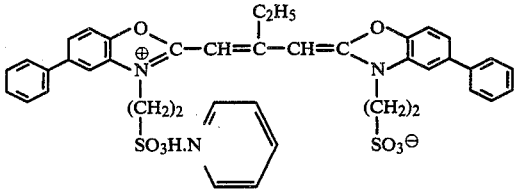
B-3
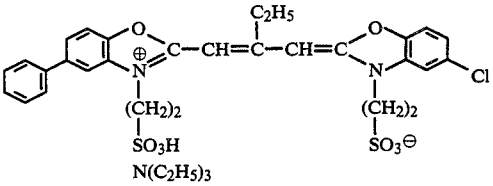
B-4
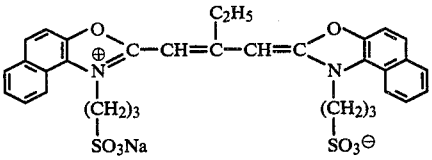
B-5
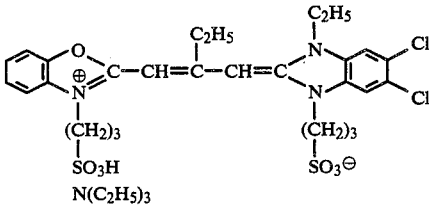
-continued
B-6
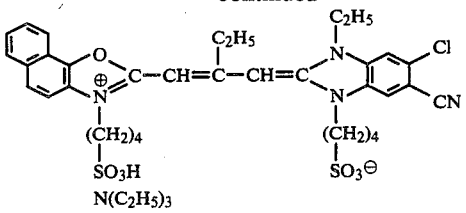
B-7
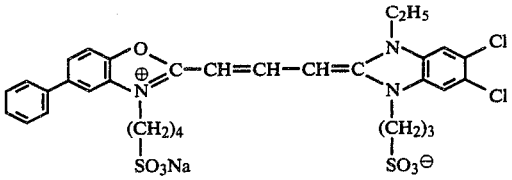
B-8
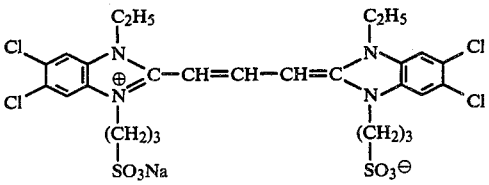
B-9
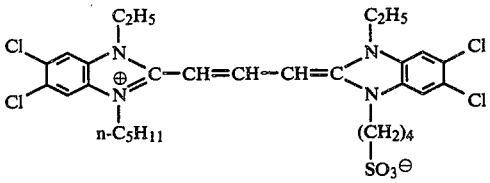
B-10
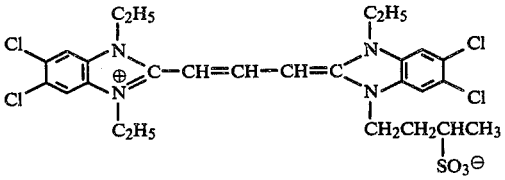
B-11
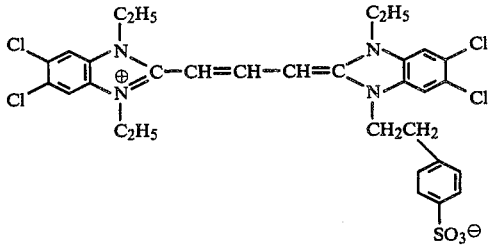
B-12
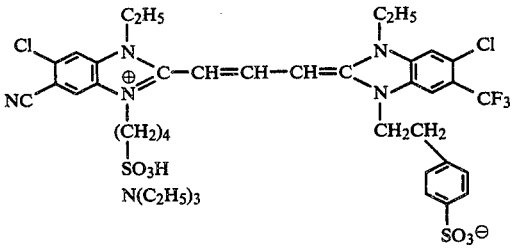
B-13
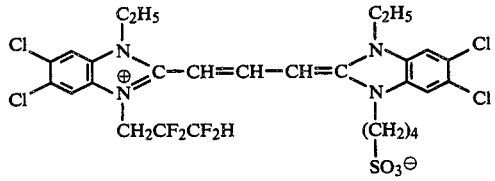

-continued

B-14

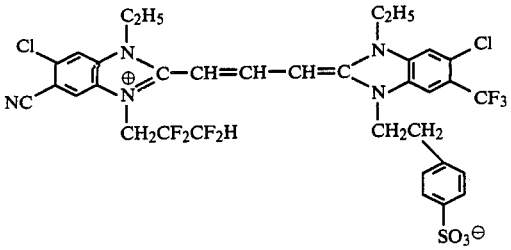

B-15

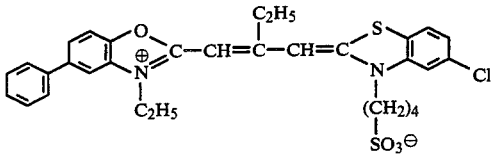

B-16

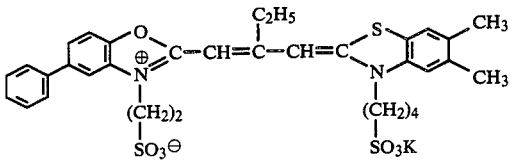

B-17

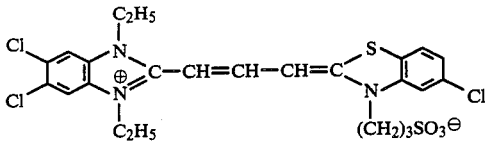

B-18

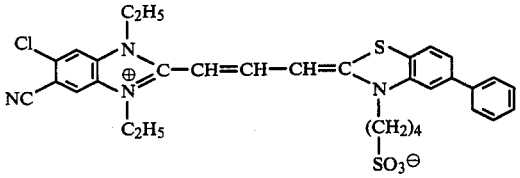

B-19

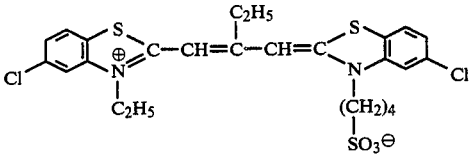

B-20

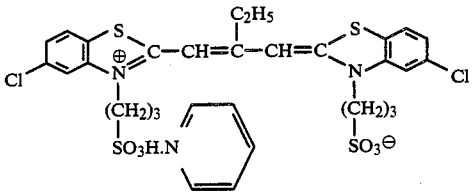

B-21

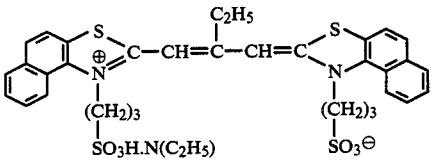

B-22

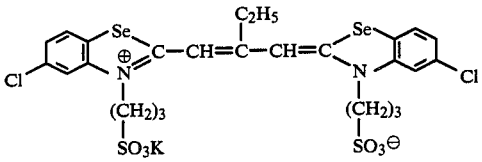

-continued

B-23

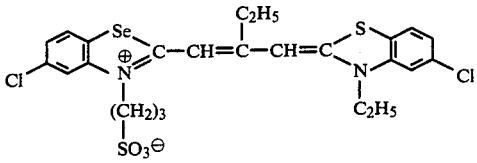

B-24

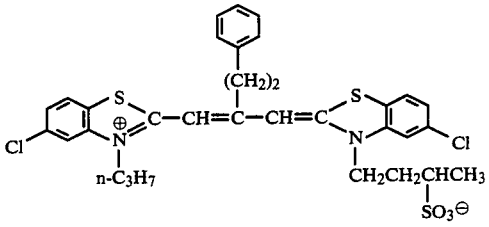

B-25

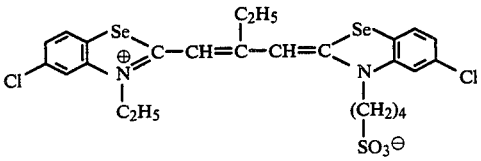

These sensitizing dyes may be used alone or in combination. Combination of sensitizing dyes is often employed particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/68, 12375/78, Japanese Patent Application (OPI) Nos. 110618/77 and 109925/77.

A dye which itself does not have a spectrally sensitizing effect or a substance which substantially does not absorb visible light and which shows a supersensitizing effect may be incorporated together with the sensitizing dye.

Each of the light-sensitive emulsion layers in accordance with the present invention may be separated into two or more layers. In such cases, the higher speed layer is desirably positioned on and above the lower speed layer of the same color sensitivity.

As a binder for each light-sensitive photographic emulsion layer and interlayer or other constituent layers of the light-sensitive material of the present invention, gelatin is advantageously used. However, other hydrophilic colloids can be used as well. For example, proteins such as gelatin derivatives, graft polymers between gelatin and other high polymers, albumin, casein, etc.; cellulose derivatives such as hydroxyethyl cellulose, carboxymethyl cellulose, cellulose sulfate, etc.; sugar derivatives such as sodium alginate, starch derivative, etc.; and various synthetic hydrophilic high molecular substances such as homopolymers or copolymers (e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.) can be used.

As gelatin, acid-processed gelatin or enzyme-processed gelatin as described in Bull. Soc. Sci. Phot. Japan, No. 16, p. 30 (1966) may be used as well as lime-processed gelatin, and a gelatin hydrolyzate or enzyme-decomposed product can be used. As the gelatin derivatives, those obtained by reacting gelatin with, for example, acid halides, acid anhydrides, isocyanates, bromoacetic acid, alkanesultones, vinylsulfonamides, maleinimide compounds, polyalkylene oxides, epoxy compounds or the like can be used. Specific examples thereof are described in U.S. Pat. Nos. 2,614,928, 3,132,945, 3,186,846, 3,312,553, British Patents 861,414, 1,033,189, 1,005,784, Japanese Patent Publication No. 26845/67, etc.

As the aforesaid gelatin graft polymers, products prepared by grafting to gelatin a homo- or copolymer of vinyl monomer such as acrylic acid, methacrylic acid, ester or amide thereof, acrylonitrile, styrene, or the like can be used. In particular, graft polymers of gelatin and a polymer having some compatibility with gelatin such as a polymer of acrylic acid, methacrylic acid, acrylamide, methacrylamide, hydroxyalkyl methacrylate or the like are preferable. Examples of these are described in U.S. Pat. Nos. 2,763,625, 2,831,767, 2,956,884, etc.

Typical synthetic hydrophilic high molecular substances are those described in, for example, West German Patent Application (OLS) No. 2,312,708, U.S. Pat. Nos. 3,620,751, 3,879,205, and Japanese Patent Publication No. 7561/68.

For the purpose of enhancing sensitivity and contrast or accelerating development, the light-sensitive material of the present invention may contain, for example, polylakylene oxides or the ether, ester or amine derivatives thereof, thioether compounds, thiomorpholines, quaternary ammonium salts, urethane derivatives, urea derivatives, imidazole derivatives, 3-pyrazolidones, etc. For example, those described in U.S. Pat. Nos. 2,400,532, 2,423,549, 2,716,062, 3,617,280, 3,772,021, 3,808,003, etc., can be used.

Various compounds may be incorporated in the light-sensitive material of the present invention as antifogging agents or stabilizers. That is, many compounds known as antifogging agents or stabilizers such as azoles (e.g., benzothiazolium salts, nitroindazoles, triazoles, benzotriazoles, benzimidazoles (particularly, nitro- or halogen-substituted derivatives), etc.); hetero ring-containing mercapto compounds (e.g., mercaptothiazoles, mercaptobenzothiazoles, mercaptobenzimidazoles, mercaptothiadiazoles, mercaptotetrazoles (particularly, 1-phenyl-5-mercaptotetrazole, etc.), and mercaptopyridines); hetero ring-containing mercapto compounds described having a water-soluble group such as a carboxyl group or a sulfo group; thioketo compounds (e.g., oxazolinethione); azaindenes (e.g., tetraazaindenes (particularly 4-hydroxy-substituted (1,3,3a,7)-tetraazaindenes); benzenethiosulfonic acids; benzenesulfinic acids; etc., can be added.

As to more specific examples and manners of using them, reference can be made, for example, to U.S. Pat. Nos. 3,954,474, 3,982,947, 4,021,248, and Japanese Patent Publication No. 28660/77.

The photographic light-sensitive material of the present invention may contain an organic or inorganic hardener in its photographic emulsion layers or other constituent layers. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc., can be used alone or in combination.

The photographic light-sensitive material of the present invention may contain in its photographic emulsion layers or other constituent layers various surfactants for various purposes, such as improvement of coating properties, antistatic properties, slipping properties, emulsion dispersibility, anti-adhesion properties, and photographic properties (for example, development acceleration, realization of high contrast tone, sensitization, etc.).

Examples of useful surfactants include nonionic surface active agents such as saponin (steroid type), alkylene oxide derivatives (e.g., polyethylene glycol, polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (e.g., alkenylsuccinic acid polyglyceride, alkylphenol polyglyceride, etc.), fatty acid esters of polyhydric alcohols, sugar alkyl esters, etc.; anionic surfactants having an acidic group such as a carboxy group, a sulfo group, a phospho group, a sulfuric ester group or a phosphoric ester group (e.g., alkylcarboxylates, alkylsulfonates, alkylbenzenesulfonates, alkylnaphthalenesulfonates, alkylsulfates, alkyl phosphates, N-acyl-N-alkyltaurine, sulfosuccinic acid ester, sulfoalkylpolyoxyethylene alkylphenyl ethers, polyoxyethylene alkylphosphates, etc.; amphoteric surfactants such as amino acids, aminoalkylsulfonic acids, aminoalkylsulfuric or phosphoric esters, alkylbetaines, amine oxides, etc.; and cationic surfactants such as alkylamine salts, aliphatic or aromatic quaternary ammonium salts, hetero ring quaternary ammonium salts such as pyridinium, imidazolium, etc., and phosphonium or sulfonium salts containing aliphatic or heterocyclyl ring.

The light-sensitive material of the present invention may contain a developing agent. As the developing agent, those described in *Research Disclosure,* Vol. 176, p. 29, paragraph entitled "Developing agent", can be used.

The light-sensitive material to be prepared by the present invention may contain dyes as filter dyes or for various other purposes, including prevention of irradiation in photographic emulsion layers or other constituent layers. As the dyes, those described in *Research Disclosure,* Vol. 176, pp, 25–26, paragraph entitled "Absorbing and filter dyes", can be used.

The light-sensitive material of the present invention can further contain antistatic agents, plasticizers, matting agents, lubricants, UV ray absorbers, fluorescent brightening agents, air fog-preventing agents, etc.

The silver halide emulsion layers and other constituent layers can be coated on a support in a manner as described, for example, in *Research Disclosure,* Vol. 176, pp. 27–28, paragraph entitled "Coating procedures".

Photographic processing of the light-sensitive material of the present invention can be conducted according to any known color image-forming process, as described, for example, in *Research Disclosure,* Vol. 176, pp. 28–30. Processing temperature is preferably selected between 18° and 60° C.

In processing a color reversal light-sensitive material according to a preferable embodiment of the present invention, there are usually used the steps of: black-and-white development (first development)→stopping- →washing with water→reversing→washing with water→color development=stopping→washing with water→conditioning bath→washing with water→bleaching→washing with water→fixing→washing with water→stabilizing→drying. In addition, pre-bath, prehardening bath, neutralizing bath, etc., may be provided in this processing. Washing steps after the stopping step, reversing step, color developing step, conditioning bath or bleaching step may be omitted. The reversing step may be conducted in a fogging bath or by reexposure, or may be omitted by adding a fogging agent to the color developing bath. Still further, the conditioning bath may be omitted.

In the first developing solution to be used in the present invention, known developing agents may be used. As the developing agents, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, hetero ring compounds wherein a 1,2,3,4-tetrahydroquinoline ring and an indolenine ring are fused to each other as described in U.S. Pat. No. 4,067,872, and the like can be used alone or in combination.

In the black-and-white developer to be used in accordance with the present invention, preservatives (e.g., sulfites, bisulfites, etc.), buffering agents (e.g., carbonates, boric acid, borates, alkanolamines, etc.), alkali agents (e.g., hydroxides, carbonates, etc.), dissolving aids (e.g., polyethylene glycols and their esters), pH-adjusting agents (e.g., organic acids such as acetic acid), sensitizing agents (e.g., quaternary ammonium salts), development accelerators, surfactants, toning agents, defoaming agents, hardeners, viscosity-imparting agents, etc., may be incorporated as the case demands.

In the first developer to be used in the present invention must be incorporated a compound which functions as a silver halide solvent. Usually, the above-described sulfites to be added as preservatives also act as the solvents. Specific examples of the sulfites and other usable silver halide solvents include KSCN, NaSCN, $K_2SO_3$, $Na_2SO_3$, $K_2S_2O_5$, $Na_2S_2O_5$, $K_2S_2O_3$, $Na_2S_2O_3$, etc.

When these silver halide solvents are used in too small amounts, delayed development results, whereas when used in excessive amounts, they fog a silver halide emulsion. Thus, there exists a preferable amount for a particular system, which can be easily decided by those skilled in the art.

For example, in using $SCN^{\ominus}$, it is used in an amount of from 0.005 to 0.02 mol, and preferably from 0.01 to 0.015 mol, per liter of developer and, in using $SO_3^{2\ominus}$, it is used in an amount of from 0.05 to 1 mol, and preferably from 0.1 to 0.5 mol, per liter of developer.

Further, the first developer may contain antifogging agents (for example, halides such as potassium bromide, sodium bromide, etc., benzimidazoles, benzotriazoles, benzothiazoles, tetrazoles, thiazoles, etc.), and chelating agents (e.g., ethylenediaminetetraacetic acid, alkali metal salts thereof, polyphosphoric acid salts, nitrilotriacetic acid salts, etc.).

The pH of the developer thus prepared is selected so as to give desired density and contrast, preferably pH of between about 8.5 and about 11.5.

Push processing using the first developer may usually be conducted by prolonging the processing period three times, at the most, that of normal processing. An increase in processing temperature can shorten the prolonged period for push processing.

The fogging bath to be used in the present invention may contain known fogging agents, such as stannous ion complexes such as stannous ion-organophosphoric acid complex salts (U.S. Pat. No. 3,617,282), stannous ion-organic phosphonocarboxylic acid complex salts (Japanese Patent Publication No. 32616/81), stannous ion-aminopolycarboxylic acid complex salts (British Pat. No. 1,209,050), etc., boron compounds such as boron hydride compounds (U.S. Pat. No. 2,984,567), heterocyclylamine borane compounds (British Patent 1,011,000), etc., and the like. The pH of this fogging bath (reversing bath) ranges from acid side to alkali side widely, i.e., 2 to 12, preferably 2.5 to 10, more preferably 3 to 9.

The color developer to be used in the present invention has a composition of conventional color developer containing an aromatic primary amine developing agent. Preferable examples of the aromatic primary amine color developing agent are p-phenylenediamine derivatives such as N,N-diethyl-p-phenylenediamine, 2-amino-5-diethylaminotoluene, 2-amino-5-(N-ethyl-N-laurylamino)toluene, 4-[N-ethyl-N-(β-hydroxyethyl-)amino]-aniline, 2-methyl-4-[N-ethyl-N-(β-hydroxethyl)amino]-aniline, N-ethyl-N-(β-methanesulfonamidoethyl)-3-methyl-4-aminoaniline, N-(2-amino-5-diethylaminophenylethyl)-methanesulfonamide, N,N-dimethyl-p-phenylenediamine, 4-amino-3-methyl-N-ethyl-N-methoxyethylaniline described in U.S. Pat. Nos. 3,656,950, 3,698,525, etc., 4-amino-3-methyl-N-ethyl-N-β-ethoxyethylaniline, and 4-amino-3-methyl-N-ethyl-N-β-butoxyethylaniline, and the salts thereof (for example, sulfates, hydrochlorides, sulfites, p-toluenesulfonates, etc.), etc.

The color developer may further contain known developer ingredient compounds. For example, alkali agents and buffers, such as sodium hydroxide, potassium hydroxide, sodium carbonate, potassium carbonate, sodium tertiary phosphate or potassium tertiary phosphate, potassium metaborate, borax, etc., may be used alone or in combination.

To the color developer may be added sulfites (e.g., sodium sulfite, potassium sulfite, potassium bisulfite, sodium bisulfite, etc.), which are usually used as preservatives, and hydroxylamine.

Any development accelerator may be added to the color developer. For example, various cationic compounds such as pyridinium compounds as described in U.S. Pat. Nos. 2,648,604 and 3,671,247, and Japanese Patent Publication No. 9503/69, cationic dyes such as phenosafranine, neutral salts such as thallium nitrate and potassium nitrate, nonionic compounds such as polyethylene glycol and its derivatives, polythioethers, etc., described in Japanese Patent Publication No. 9504/69, U.S. Pat. Nos. 2,533,990, 2,531,832, 2,950,970 and 2,577,127, organic solvents described in Belgian Patent 682,862, organic amines such as ethanolamine, ethylenediamine, diethanolamine, etc., and those development accelerators which are described in L.F.A. Mason, *Photographic Processing Chemistry*, pp. 40–43 (Focal Press, London, 1966) may be used.

The color developer may further contain aminopolycarboxylic acids exemplified by ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, etc., as water softeners.

Color couplers, competitive couplers and compensating developers may also be added to the color developer.

As competitive couplers, citrazinic acid, J-acid (6-amino-1-naphthol-3-sulfonic acid), H-acid (8-amino-1-naphthol-3,6-disulfonic acid), etc., are useful.

As compensating developers, p-aminophenol, N-benzyl-p-aminophenol, 1-phenyl-3-pyrazolidone, etc., may be used.

The pH of the color developer is preferably in the range of from about 8 to about 13. Temperature of the color developer is generally selected to be between 20° C. and 70° C., and preferably between 30° C. and 60° C.

After color development processing, photographic emulsion layers are usually bleached. Bleaching may be conducted simultaneously with, or separately from, fixing. As bleaching agents, compounds of polyvalent metals such as iron (III), cobalt (IV), chromium (VI), copper (II), etc., peracids, quinones, nitron compounds, and the like are used. For example, ferricyanides; dichromates; organic complex salts of iron (III) or cobalt (IV) such as complex salts with organic acid, e.g., aminopolycarboxylic acids (e.g., ethylenediaminetetraacetic acid, nitrilotriacetic acid, 1,3-diamino-2-propanol-tetraacetic acid), citric acid, tartaric acid, malic acid, etc.; persulfates and permanganates; and nitrosophenol may be used. Of these, potassium ferricyanide, iron (III) sodium ethylenediaminetetraacetate, and iron (III) ammonium ethylenediaminetetraacetate are particularly useful. Iron (III) aminopolycarboxylates are useful in both an independent bleaching solution and a mono-bath bleach-fixing solution.

Various additives including bleaching acc lerators as described in U.S. Pat. Nos. 3,042,520, 3,241,966, Japanese Patent Publication Nos. 8506/70 and 8836/70, etc., may be added to bleaching solutions or bleach-fixing solutions.

The fixing bath to be used in accordance with the present invention contains a fixing agent such as ammonium, sodium or potassium thiosulfate in an amount of about 30 g/liter to about 200 g/liter and may further contain stabilizers (e.g., sulfites, metabisulfites, etc.), hardeners (e.g., potash alum), pH buffers (e.g., acetates, borates, phosphates, carbonates, etc.), and the like. The pH of the fixng solution ranges from 3 to 10, and preferably from 5 to 9.

The present invention will now be described in more detail by reference to non-limiting examples of preferred embodiments of the present invention.

EXAMPLE 1

On a triacetate film base were coated, in the following order, a first layer through a twelfth layer to prepare a color reversal photographic light-sensitive material.

First Layer: Antihalation Layer (gelatin layer containing black colloidal silver)

Second Layer: Gelatin Interlayer 2 kg of an emulsion, obtained by stirring at high speed a solution of 2,5-di-t-octylhydroquinone in a mixture of 100 cc of dibutyl phthalate and 100 cc of ethyl acetate and 1 kg of a 10% gelatin aqueous solution, was mixed with 1.5 kg of 10% gelatin together with 1 kg of a fine grain-containing emulsion not chemically sensitized (grain size: 0.06μ; 1 mol% silver bromoiodide), and the resulting solution was coated to provide a dry thickness of 2μ (silver amount: 0.4 g/m$^2$).

Third Layer: Lower Speed Red-Sensitive Emulsion Layer 500 g of an emulsion, obtained by stirring at high speed a solution of 100 g of a cyan coupler of 2-(heptafluorobutyramido)-5-[2'-(2'',4''-di-t-amylphenoxy)-butyramido]phenol in a mixture of 100 cc of tricresyl phosphate and 100 cc of ethyl acetate and 1 kg of 10% gelatin aqueous solution, was mixed with 1 kg of a red-sensitive silver bromoiodide emulsion (containing 70 g of silver and 60 g of gelatin; iodide content: 6 mol%), then coated to provide a dry thickness of 1μ (silver amount: 0.5 g/m$^2$).

Fourth Layer: Higher Speed Red-Sensitive Emulsion Layer 1,000 g of an emulsion, obtained by stirring at high speed a solution of 100 g of a cyan coupler of 2-(heptafluorobutyramido)-5-[2'-(2'',4''-di-t-amylphenoxy)-butyramido]phenol in a mixture of 100 cc of tricresyl phosphate and 100 cc of ethyl acetate and 1 kg of 10% gelatin aqueous solution, was mixed with 1 kg of a red-sensitive silver bromoiodide emulsion (containing 70 g of silver and 60 g of gelatin; iodide content: 6 mol%), then coated to provide a dry thickness of 2.5μ (silver amount: 0.8 g/m$^2$).

Fifth Layer: Interlayer 1 kg of an emulsion, obtained by stirring at high speed a solution of 2,5-di-t-octylhydroquinone in a mixture of 100 cc of dibutyl phthalate and 100 cc of ethyl acetate and 1 kg of a 10% gelatin aqueous solution, was mixed with 1 kg of a 10% gelatin aqueous solution, then coated to provide a dry thickness of 1μ.

Sixth Layer: Lower Speed Green-Sensitive Emulsion Layer 300 g of an emulsion, obtained in the same manner as with the emulsion of the First Layer except for using a magenta coupler of 1-(2,4,6-trichlorophenyl)-3-[3-(2,4-di-t-amylphenoxyacetamido)benzamido]-5-pyrazolone in place of the cyan coupler, was mixed with 1 kg of a green-sensitive silver bromoiodide emulsion (containing 70 g of silver and 60 g of gelatin; iodide content: 7 mol%), then coated to provide a dry thickness of 1.3μ (silver amount: 1.1 g/m$^2$).

Seventh Layer: Higher Speed Green-Sensitive Emulsion Layer 1,000 g of an emulsion, obtained in the same manner as with the emulsion of the First Layer except for using a magneta coupler of 1-(2,4,6-trichlorophenyl)-3-[3-(2,4-di-t-amylphenoxyacetamido)benzamido]-5-pyrazolone in place of the cyan coupler, was mixed with 1 kg of a green-sensitive silver bromoiodide emulsion (containing 70 g of silver and 60 g of gelatin; iodide content: 6 mol%), then coated to provide a dry thickness of 3.5μ (silver amount: 1.1 g/m$^2$).

Eighth Layer: Yellow Filter Layer

An emulsion containing yellow colloidal silver was coated to provide a dry thickness of 1μ.

Ninth Layer: Lower Speed Blue-Sensitive Emulsion Layer 1,000 g of an emulsion, obtained in the same manner as with the emulsion of the First Layer except for using a yellow coupler of α-(pivaloyl)-α-(1-benzyl-5-ethoxy-3-hydantoinyl)-2-chloro-5-dodecyloxycarbonylacetanilide in place of the cyan coupler, was mixed with 1 kg of a blue-sensitive silver bromoiodide emulsion (containing 70 g of silver and 60 g of gelatin; iodide content: 7 mol%), then coated to provide a dry thickness of 1.5μ (silver amount: 0.4 g/m$^2$).

Tenth Layer: Higher Speed Blue-Sensitive Emulsion Layer 1,000 g of an emulsion, obtained in the same manner as with the emulsion of the First Layer except for using a yellow coupler of α-(pivaloyl)-α-(1-benzyl-5-ethoxy-3-hydantoinyl)-2-chloro-5-dodecyloxycarbonylacetanilide in place of the cyan coupler, was mixed with 1 kg of a blue-sensitive silver bromoiodide emulsion (containing 70 g of silver and 60 g of gelatin; iodide content: 6 mol%), then coated to provide a dry thickness of 3μ (silver amount: 0.8 g/m$^2$).

Eleventh Layer: Second Protective Layer 1 kg of the same emulsion as used in the Third Layer was mixed with 1 kg of 10% gelatin and coated to provide a dry thickness of 2μ.

Twelfth Layer: First Protective Layer:

A 10% gelatin aqueous solution containing a surface-fogged fine grain-containing emulsion (grain size: 0.06μ; 1 mol% silver bromoiodide emulsion) was coated in a coated silver amount of 0.1 g/m$^2$ and to provide a dry thickness of 0.8μ.

The thus prepared sample was referred to as Sample 101, which was used as a comparative sample hereinafter.

Next, an emulsion containing silver bromide cubic grains having a mean grain size of 0.15μ was prepared according to the controlled double jet process, then fogged at a low pAg using hydrazine and gold complex salt. The thus prepared emulsion was referred to as Emulsion A. Emulsions B and C were prepared by shelling the surface of silver bromide grains of Emulsion A with silver bromide in thicknesses of 250 Å and 500 Å, respectively. Emulsions B and C were not subjected to chemical sensitization.

Each of the thus prepared Emulsions A, B and C was added to the Sixth Layer of lower speed green-sensitive emulsion layer and coated in an amount given in Table 1 to prepare Samples 102 to 104.

Each of the thus prepared samples was exposed through a wedge for sensitometry using white light emitted from a 4,800°K. light source with an illuminance at exposed surface of 1,000 lux, then subjected to the following normal reversing processing or reversing push processing to obtain color images.

Processing steps and processing solutions used here are as follows.

| Step | Time | Temperature |
|---|---|---|
| Normal Processing Steps | | |
| First Development | 6 min | 38° C. |
| Washing with Water | 2 min | " |
| Reversing | 2 min | " |
| Color Development | 6 min | " |
| Conditioning | 2 min | " |
| Bleaching | 6 min | " |
| Fixing | 4 min | " |
| Washing with Water | 4 min | " |
| Stabilizing | 1 min | Ordinary Temperature (about 20° C.) |
| Drying | | |
| Push Processing Steps | | |
| First Development | 10 min | 38° C. |
| Washing with Water | 2 min | " |
| Reversing | 2 min | " |
| Color Development | 6 min | " |
| Conditioning | 2 min | " |
| Bleaching | 6 min | " |
| Fixing | 4 min | " |
| Washing with Water | 4 min | " |
| Stabiliziing | 1 min | Ordinary Temperature (about 20° C.) |
| Drying | | |

Formulations of the processing solutions used are as follows.

| | |
|---|---|
| First Developer: | |
| Water | 700 ml |
| Sodium Tetrapolyphosphate | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml (pH 10.1) |
| Reversing Solution: | |
| Water | 700 ml |
| Nitro-N,N,N—trimethylene Phosphonic Acid 6 Na Salt | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| Color Developer: | |
| Water | 700 ml |
| Sodium Tetrapolyphosphate | 2 g |
| Sodium Sulfite | 7 g |
| Sodium Tertiary Phosphate (12 hydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| Ethylenediamine | 3 g |
| Water to make | 1,000 ml |
| Conditioning Solution: | |
| Water | 700 ml |
| Sodium Sulfite | 12 g |
| Sodium Ethylenediaminetetraacetate (dihydrate) | 8 g |
| Thioglycerin | 0.4 ml |
| Glacial Acetic Acid | 3 ml |
| Water to make | 1,000 ml |
| Bleaching Solution: | |
| Water | 800 ml |
| Sodium Ethylenediaminetetraacetate (dihydrate) | 2.0 g |
| Iron (III) Ammonium Ethylenediaminetetraacetate (diihydrate) | 120.0 g |
| Potassium Bromide | 100.0 g |

-continued

| | |
|---|---|
| Water to make | 1,000 ml |
| Fixing Solution: | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| Stabilizing Solution: | |
| Water | 800 ml |
| Formalin (37 wt %) | 5.0 ml |
| Fuji Driwel | 5.0 ml |
| Water to make | 1,000 ml |

Optical density of magenta image of each sample thus processed was measured through a green filter to evaluate sensitization developability. Sensitivity was presented as a reciprocal of an exposure amount necessary for obtaining a definite density (D=1.00) of magneta color, which was determined from characteristic curve.

The results thus obtained are shown in Table 1.

TABLE 1

| Sample No. | Emulsion Added to Lower Speed Green-Sensitive Layer; Thickness of Shell; and Silver Amount Coated | Normal Processing (first development: 6 min) Relative Sensitivity | Normal Processing (first development: 6 min) Maximum Density | Push Processing (first development: 10 min) Relative Sensitivity | Push Processing (first development: 10 min) Maximum Density |
|---|---|---|---|---|---|
| 101 | — | 100 | 3.06 | 209 | 2.42 |
| 102 | Emulsion A; No shell; 0.01 g/m$^2$ | 115 | 2.96 | 324 | 2.22 |
| 103 | Emulsion B; 250 Å; 0.02 g/m$^2$ | 98 | 3.04 | 276 | 2.34 |
| 104 | Emulsion C; 500 Å; 0.04 g/m$^2$ | 96 | 3.06 | 271 | 2.37 |

It is seen from Table 1 that the sample prepared by adding surface-fogged Emulsion A to the lower speed green-sensitive emulsion layer (Sample 102) showed a more increase in speed than the surface-fogged emulsion-free sample (Sample 101) when subjected to push processing. However, Sample 102 suffered a serious decrease in maximum density when subjected to the push processing and, in addition, suffered a decrease in maximum density when subjected to normal processing, thus not being preferable.

In contrast, it is also seen that Samples 103 and 104 prepared by adding, respectively, Emulsions B and C formed by shelling Emulsion A to the lower speed green-sensitive emulsion layer showed an increase in speed when subjected to the push processing, without suffering a decrease in maximum density in normal processing. In addition, they suffered a less decrease in maximum density in push processing than the sample containing shell-free Emulsion A.

EXAMPLE 2

Sample 202 was prepared in the same manner as with Sample 103 in Example 1 except for adding Emulsion B prepared in the same manner as in Example 1 to the Seventh Layer of higher speed green-sensitive emulsion layer of Example 1.

The thus obtained sample was exposed and developed in the same manner as in Example 1, together with Sample 201 prepared in the same manner as with Sample 101 in Example 1, to obtain color images.

The optical density of the magenta image of each of the resulting samples was measured through a green filter to evaluate developability in push processing. Sensitivity was presented as a reciprocal of an exposure amount necessary for obtaining a definite magneta color density (D=1.00 and 2.00) determined from characteristic curves.

The results thus obtained are tabulated in Table 2.

TABLE 2

| Sample No. | Emulsion Added to Higher Speed Green-Sensitive Emulsion Layer; Thickness of Shell; and Ag Amount Coated | Normal Processing (first development: 6 minutes) D = 1.0* | Normal Processing D = 2.0* | Normal Processing $D_{max}$ | Push Processing (first development: 10 minutes) D = 1.0* | Push Processing D = 2.0* | Push Processing $D_{max}$ |
|---|---|---|---|---|---|---|---|
| 201 | — | 100 | 339 | 3.02 | 282 | 708 | 2.43 |
| 202 | Emulsion B; 250 Å; 0.02 g/m$^2$ | 98 | 323 | 3.07 | 275 | 900 | 2.42 |

*Relative sensitivity

It is seen from Table 2 that the sample containing Emulsion B added to the higher speed green-sensitive emulsion layer showed particular increase in speed in high density area (D=2.0).

EXAMPLE 3

Sample 302 was prepared in the same manner as Sample 103 in Example 1, except for adding Emulsion B prepared in the same manner as in Example 1 to the Ninth Layer of the lower speed blue-sensitive emulsion layer of Example 1.

The thus obtained sample was exposed and developed in the same manner as in Example 1 together with Sample 301 prepared in the same manner as with Sample 101 in Example 1 to obtain color images.

The optical density of the yellow image of each of the resulting samples was measured through a blue filter to evaluate developability in push processing. The sensitivity was presented as a reciprocal of an exposure amount necessary for obtaining a definite yellow color density (D=1.00) determined from characteristic curves.

The results thus obtained are tabulated in Table 3.

TABLE 3

| Sample No. | Emulsion Added to Lower Speed Blue-Sensitive Layer; Thickness of Shell; and Ag Amount Coated | Normal Processing (first development: 6 minutes) * | Normal Processing $D_{max}$ | Push Processing (first development: 10 minutes) * | Push Processing $D_{max}$ |
|---|---|---|---|---|---|
| 301 | — | 100 | 3.07 | 229 | 2.55 |
| 302 | Emulsion B; 250 Å; 0.015 g/m$^2$ | 112 | 2.92 | 315 | 2.28 |

*Relative sensitivity

It is seen from Table 3 that the sample containing Emulsion B added to the lower speed blue-sensitive emulsion layer showed an increase in speed when subjected to push processing.

EXAMPLE 4

A sample prepared by applying Emulsion B containing internal fog centers used in Example 1 so as to result in a silver amount of 0.5 g/m$^2$ was used as Sample 401, which was used hereinafter as a comparative sample.

After compounds shown in Table 4 were added to the same emulsions as that used in Sample 401 to adsorb on the surface of emulsion grains, the resulted emulsions were applied in the same manner as in Sample 401 to produce Samples 402 to 413.

These samples (without exposing to light) were processed at 38° C. with the first developer used in Example 1 with varying the development time as shown in Table 4. Optical density of developed silver in the resulted samples were measured. Results are shown in Table 4.

TABLE 4

| Sample No. | Compound Added to Emulsion and Amount Added (mol/kg emulsion) | | Optical Density of Developed Silver: Development for 2 Min | Development for 4 Min | Development for 6 Min | Development for 8 Min | Development for 10 Min |
|---|---|---|---|---|---|---|---|
| 401 | — | | 0.02 | 0.17 | 0.18 | 0.19 | 0.19 |
| 402 | I-1 | $3 \times 10^{-4}$ | 0.02 | 0.06 | 0.06 | 0.18 | 0.18 |
| 403 | " | $6 \times 10^{-4}$ | 0.02 | 0.05 | 0.08 | 0.10 | 0.18 |
| 404 | " | $12 \times 10^{-4}$ | 0.02 | 0.03 | 0.08 | 0.11 | 0.18 |
| 405 | II-2 | $1 \times 10^{-4}$ | 0.02 | 0.16 | 0.19 | 0.18 | 0.19 |
| 406 | " | $3 \times 10^{-4}$ | 0.03 | 0.08 | 0.12 | 0.18 | 0.18 |
| 407 | " | $6 \times 10^{-4}$ | 0.02 | 0.05 | 0.08 | 0.09 | 0.15 |
| 408 | III-12 | $1 \times 10^{-3}$ | 0.00 | 0.02 | 0.13 | 0.16 | 0.18 |
| 409 | " | $2 \times 10^{-3}$ | 0.01 | 0.03 | 0.05 | 0.11 | 0.14 |
| 410 | " | $4 \times 10^{-3}$ | 0.02 | 0.06 | 0.07 | 0.16 | 0.17 |
| 411 | IV-4 | $1 \times 10^{-3}$ | 0.00 | 0.01 | 0.15 | 0.17 | 0.15 |
| 412 | " | $2 \times 10^{-3}$ | 0.00 | 0.01 | 0.16 | 0.15 | 0.16 |
| 413 | " | $4 \times 10^{-3}$ | 0.03 | 0.12 | 0.17 | 0.18 | 0.17 |

The results obtained from Sample 401 shows that the shell in Emulsion B has an ability of delaying the occurrence of development by fog centers for at least 2 minutes after immersion in the developer. The results obtained from Samples 402 to 413 show that occurrence of development by fog centers can be further delayed by allowing to adsorb various compounds on the surface of shells in Emulsion B.

EXAMPLE 5

Sample 101 used in Example 1 was modified as follows to produce Sample 501. Emulsion B containing internal fog centers used in Example 1 was added to Third Layer (lower speed red-sensitive emulsion layer), Sixth Layer (lower speed green-sensitive emulsion layer) and Ninth Layer (lower speed blue-sensitive emulsion layer) of Sample 101 so as to result in a coated silver amount of 0.017 g/m$^2$ (Third Layer), 0.02 g/m$^2$ (Sixth Layer) and 0.015 g/m$^2$ (Ninth Layer), respectively.

On the other hand, Samples 502 to 504 were produced in the same manner as in Sample 501 except that the compound shown in Table 5 was added to Emulsion B and the resulting emulsion was added to Ninth Layer.

Samples 501 to 504 were subjected to exposing and color reversal processing (normal processing and push processing) in the same manner as in Example 1. Optical density of the resulting yellow images was measured through a blue filter to evaluate developability in push processing. Sensitivity was presented as a reciprocal of an exposure amount necessary for obtaining a definite density (D=1.00) of yellow color, which was determined from characteristic curve. (Sensitivity of Sample 301 in Example 3 obtained by normal processing was represented as 100.)

The results thus obtained are shown in Table 5.

Further, ratios of increase in speed (i.e., ratios of relative sensitivity in push processing/relative sensitivity in normal processing) in yellow, magenta and cyan images of each sample were measured. The results obtained are shown in Table 6.

TABLE 5

| Sample No. | Compound Added to Emulsion B and Amount Added (mol/kg emulsion) | Normal Processing: Relative Sensitivity | Normal Processing $D_{max}$ | Push Processing: Relative Sensitivity | Push Processing $D_{max}$ |
|---|---|---|---|---|---|
| 501 | No addition | 112 | 2.92 | 325 | 2.28 |
| 502 | I-1 ($1.5 \times 10^{-4}$) | 105 | 2.95 | 283 | 2.32 |
| 503 | II-2 ($1.0 \times 10^{-4}$) | 107 | 2.93 | 300 | 2.35 |
| 504 | III-12 ($2.0 \times 10^{-3}$) | 102 | 2.95 | 287 | 2.37 |

TABLE 6

| Sample No. | Ratio of Increase in Speed: Red-Sensitive Layer | Green-Sensitive Layer | Blue-Sensitive Layer |
|---|---|---|---|
| 501 | 2.80 | 2.82 | 2.90 |
| 502 | " | " | 2.81 |
| 503 | " | " | 2.80 |
| 504 | " | " | 2.81 |

It is seen from Table 5 and Table 6 that the degree of increase in speed by push processing can be controlled by allowing to adsorb the compounds of the present invention on the surface of emulsion grains containing internal fog centers, and thus color balance of the red-sensitive layer, the green-sensitive layer and the blue-sensitive layer in push processing can be easily controlled.

EXAMPLE 6

Samples 601 to 605 were prepared in the same manner as Sample 101 in Example 1, except for sensitizing the light-sensitive silver halide emulsion in Third Layer (lower speed red-sensitive emulsion layer) by the sensitizing dye and adding Emulsion B to the Third Layer as indicated in Table 7.

The thus obtained samples were exposed and developed in the same manner as in Example 1.

The optical density of the cyan image of each of the resulting samples was measured through a red filter. The sensitivity was presented as reciprocal of an exposure amount necessary for obtaining a cyan color density (D=1.0) determined from characteristic curves.

The results thus obtained are tabulated in Table 7.

TABLE 7

| Sample No. | Emulsion B Added to Lower Speed Red-Sensitive Layer (Ag amount coated) ($g/m^2$) | Sensitizing Dye for Lower Speed Red-Sensitive Layer (amount*) | Normal Processing (first development time: 6 minutes) Relative Sensitivity | Normal Processing Maximum Density | Push Processing (first development time: 10 minutes) Relative Sensitivity | Push Processing Maximum Density |
|---|---|---|---|---|---|---|
| 601 | — | B-19 ($4.2 \times 10^{-4}$) | 100 | 2.98 | 240 | 2.52 |
| 602 | 0.017 | B-19 ($4.2 \times 10^{-4}$) | 103 | 2.96 | 288 | 2.38 |
| 603 | " | B-24 ($4.2 \times 10^{-4}$) | 95 | 2.97 | 263 | 2.43 |
| 604 | " | B-25 ($4.2 \times 10^{-4}$) | 101 | 2.94 | 272 | 2.35 |
| 605 | " | Comparative Dye** ($4.2 \times 10^{-4}$) | 130 | 2.80 | 389 | 1.86 |

*mol per mol of light-sensitive silver halide therein

**Comparative Dye

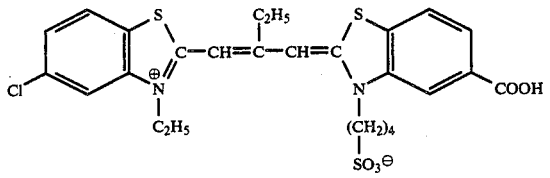

It is apparent from the results in Table 7 that the sensitizing dye according to the present invention can prevent reduction of maximum color density as compared with the comparative sensitizing dye.

EXAMPLE 7

Samples 701 to 703 were prepared in the same manner as Sample 501 in Example 5, except for sensitizing the light-sensitive silver halide emulsion in Ninth Layer (lower speed blue-sensitive layer) by the sensitizing dye as indicated in Table 8 and adding Emulsion B to the Ninth Layer as indicated in Table 8.

The thus obtained samples were exposed and developed in the same manner as in Example 1.

The optical density of the yellow image of each of the resulting samples was measured through a blue filter. The sensitivity was presented as reciprocal of an exposure amount necessary for obtaining a yellow color density (D=1.0) determined from characteristic curves.

The results thus obtained are tabulated in Table 8.

TABLE 8

| Sample No. | Emulsion B Added to Lower Speed Blue-Sensitive Layer (Ag amount coated) ($g/m^2$) | Sensitizing Dye for Lower Speed Blue-Sensitive Layer (amount*) | Normal Processing (first development time: 6 minutes) Relative Sensitivity | Normal Processing Maximum Density | Push Processing (first development time: 10 minutes) Relative Sensitivity | Push Processing Maximum Density |
|---|---|---|---|---|---|---|
| 701 | — | A-5 ($3.1 \times 10^{-4}$) | 100 | 3.07 | 229 | 2.55 |
| 702 | 0.012 | A-5 ($3.1 \times 10^{-4}$) | 105 | 2.98 | 296 | 2.36 |
| 703 | " | Comparative Dye** | 120 | 2.75 | 362 | 1.80 |

TABLE 8-continued

| Sample No. | Emulsion B Added to Lower Speed Blue-Sensitive Layer (Ag amount coated) ($g/m^2$) | Sensitizing Dye for Lower Speed Blue-Sensitive Layer (amount*) | Normal Processing (first development time: 6 minutes) Relative Sensitivity | Normal Processing Maximum Density | Push Processing (first development time: 10 minutes) Relative Sensitivity | Push Processing Maximum Density |
|---|---|---|---|---|---|---|
| | | $(3.1 \times 10^{-4})$ | | | | |

*mol per 1 mol of light-sensitive silver halide therein
**Comparative Dye

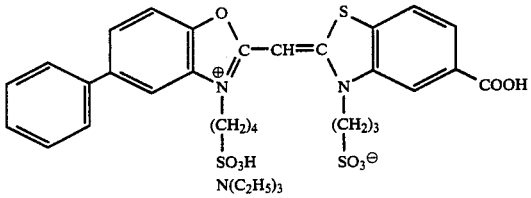

It is apparent from the results in Table 8 that the sensitizing dye according to the present invention can prevent reduction of maximum color density as compared with the comparative sensitizing dye.

EXAMPLE 8

Samples 801 to 808 were prepared in the same manner as Sample 501 in Example 5, except for adding compounds to the light-sensitive silver halide emulsion of Nonth Layer (lower speed blue-sensitive layer) as indicated in Table 9.

The thus obtained samples were exposed and developed in the same manner as in Example 1.

The optical density of the yellow image of each of the resulting samples was measured through a blue filter. The sensitivity was presented as reciprocal of an exposure amount necessary for obtaining a yellow color density (D=1.0) determined from characteristic curves.

The results thus obtained are tabulated in Table 9.

TABLE 9

| Sample No. | Emulsion B Added to Lower Speed Blue-Sensitive Layer (Ag amount coated) ($g/m^2$) | Compound Added to Lower Speed Blue-Sensitive Layer (amount*) | Normal Processing (first development time: 6 minutes) Relative Sensitivity | Normal Processing Maximum Density | Push Processing (first development time: 10 minutes) Relative Sensitivity | Push Processing Maximum Density |
|---|---|---|---|---|---|---|
| 801 | — | — | 100 | 3.07 | 229 | 2.55 |
| 802 | 0.015 | — | 112 | 2.92 | 325 | 2.28 |
| 803 | " | III-1 $(2 \times 10^{-4})$ | 100 | 2.95 | 302 | 2.32 |
| 804 | " | III-1 $(4 \times 10^{-4})$ | 91 | 2.97 | 257 | 2.38 |
| 805 | " | III-12 $(2 \times 10^{-4})$ | 110 | 2.93 | 320 | 2.30 |
| 806 | " | III-12 $(4 \times 10^{-4})$ | 105 | 2.94 | 295 | 2.34 |
| 807 | " | IV-4 $(2 \times 10^{-4})$ | 107 | 2.95 | 302 | 2.33 |
| 808 | " | IV-4 $(4 \times 10^{-4})$ | 105 | 2.95 | 296 | 2.34 |

*mol per 1 mol of light-sensitive silver halide therein

It is apparent from the results in Table 9 that the degree of increase in speed can be controlled by the combination use of the compounds according to the present invention and the light-sensitive silver halide emulsion.

While the invention has been described in detail and with reference to specific embodiments thereof, it will be apparent to one skilled in the art that various changes and modifications can be made therein without departing from the spirit and scope thereof.

What is claimed is:

1. A color reversal photographic light-sensitive material having at least one negative working type light-sensitive silver halide emulsion layer, wherein at least one of said emulsion layer and a layer adjacent thereto contains a light-insensitive silver halide emulsion of silver halide grains containing internal fog centers is, wherein said light-insensitive silver halide emulsion comprises core-shell type silver halide grains having a structure such that the surface-fogged silver halide inner core is covered with a silver halide outer shell and wherein the thickness of the outer shell is between 50 and 1,000 Å, and wherein said silver halide emulsion of silver halide grains containing fog centers is an emulsion capable of providing (1) almost no increase in density when subjected to 2-minute processing (normai processing), and (2) when subjected to 10-minute processing (push processing), an increase in density as high as at least five times that obtained by the 2-minute processing is obtained, in which the 2-minute processing and the 10-minute processing are carried out by coating the emulsion on a film support in a silver amount coated of 0.5 $g.m^2$, processing the resulting sample without exposure at 38° C. for 2 minutes (normal processing) and at 38° C. for 10 minutes (push processing) using a developer of the following formulation,

| Formulation of Developer: | |
|---|---|
| Water | 700 ml |
| Sodium Tetrapolyphosphate | 20 g |
| Sodium Sulfite | 2 g |

-continued

| Formulation of Developer: | |
|---|---|
| Hydroquinone Monosulfonate | 30 g |
| Sodium Carbonate (monohydrate) | 30 g |
| 1-Phenyl-4-methyl-4-hydroxymethyl-3-Pyrazolidone | 2 g |
| Potassium Bromide | 2.5 g |
| Potassium Thiocyanate | 1.2 g |
| Potassium Iodide (0.1% aq. soln.) | 2 ml |
| Water to make | 1 liter |

2. A color reversal photographic light-sensitive material as in claim 1, wherein from 0.0005 to 0.50 mol of the silver halide emulsion of silver halide grains containing internal fog centers is used per mol of light-sensitive silver halide emulsions used in combination thereof.

3. A color reversal photographic light-sensitive material as in claim 1, wherein from 0.001 to 0.25 mol of the silver halide emulsion of silver halide grains containing internal fog centers is used per mol of light-sensitive silver halide emulsions used in combination thereof.

4. A color reversal photographic light-sensitive material as in claim 1, wherein from 0.005 to 0.10 mol of the silver halide emulsion of silver halide grains containing internal fog centers is used per mol of light-sensitive silver halide emulsions used in combination thereof.

5. A color reversal photographic light-sensitive material as in claim 1, wherein said light-sensitive silver halide emulsion layer is formed as two or more separate layers having the same color sensitivity and unequal speed and said silver halide emulsion of silver halide grains containing internal fog centers is added to a lower speed layer of the separate layers.

6. A color reversal photographic light-sensitive material as in claim 1, wherein the material comprises a support coated thereon with at least one lower speed red-sensitive emulsion layer, at least one higher speed red-sensitive emulsion layer, at least one lower speed green-sensitive emulsion layer, at least one higher speed green-sensitive emulsion layer, at least one lower speed blue-sensitive emulsion layer and at least one higher speed blue-sensitive emulsion layer, and said silver halide emulsion of silver halide grains containing internal fog centers is added to at least one layer of the lower speed layers.

7. A process for forming a positive color image comprising imagewise exposing, black-and-white developing (first development), reversing and color developing a color reversal photographic light-sensitive material having at least one negative working type light-sensitive silver halide emulsion layer, wherein at least one of said emulsion layer and a layer adjacent thereto contains a light-insensitive silver halide emulsion of silver halide grains containing internal fog centers, wherein said light-insensitive silver halide emulsion comprises core-shell type silver halide grains having a structure such that the surface-fogged silver halide inner core is covered with a silver halide outer shell, wherein the thickness of the outer shell is between 50 and 1000 Å, and wherein said silver halide emulsion of silver halide grains containing fog centers is an emulsion capable of providing (1) almost no increase in density when subjected to 2-minute processing (normal processing), and (2) when subjected to 10-minute processing (push processing), an increase in density as high as at least five times that obtained by the 2-minute processing is obtained, in which the 2-minute processing and the 10-minute processing are carried out by coating the emulsion on a film support in a silver amount coated of 0.5 g.m$^2$, processing the resulting sample without exposure at 38° C. for 2 minutes (normal processing) and at 38° C. for 10 minutes (push processing) using a developer of the following formulation,

| Formulation of Developer: | |
|---|---|
| Water | 700 ml |
| Sodium Tetrapolyphosphate | 20 g |
| Sodium Sulfite | 2 g |
| Hydroquinone Monosulfonate | 30 g |
| Sodium Carbonate (monohydrate) | 30 g |
| 1-Phenyl-4-methyl-4-hydroxymethyl-3-Pyrazolidone | 2 g |
| Potassium Bromide | 2.5 g |
| Potassium Thiocyanate | 1.2 g |
| Potassium Iodide (0.1% aq. soln.) | 2 ml |
| Water to make | 1 liter |

and said process comprises pushing first development to increase speed.

8. A color reversal photographic light-sensitive material as claimed in claim 1, wherein the mean grain size of said silver halide grains containing internal fog centers is from 0.01 to 0.75μ.

9. A color reversal photographic light-sensitive material as in claim 8, wherein the mean grain size is from 0.01 to 0.05μ.

10. A process for forming a positive color image as in claim 7, wherein the mean grain size of said silver halide grains containing internal fog centers is from 0.01 to 0.75μ.

11. A process for forming a positive color image as in claim 10, wherein the mean grain size is from 0.01 to 0.5μ.

12. A color reversal photographic light-sensitive material as claimed in claim 1, wherein the thickness of the outer shell is between 100 and 500 Å.

13. A process for forming a positive color image as claimed in claim 7, wherein the thickness of the outer shell is between 100 and 500 Å.

* * * * *